US006049331A

United States Patent [19]

Herbert

[11] Patent Number: 6,049,331

[45] Date of Patent: Apr. 11, 2000

[54] STEP ADDRESSING IN VIDEO RAM

[75] Inventor: Brian K. Herbert, Colorado Springs, Colo.

[73] Assignee: Hyundai Electronics America, San Jose, Calif.

[21] Appl. No.: 08/065,387

[22] Filed: May 20, 1993

[51] Int. Cl.[7] ..... G09G 5/393; G09G 5/395

[52] U.S. Cl. ..... 345/203; 345/515; 345/517

[58] Field of Search ..... 345/188, 190, 345/193, 200, 203, 517, 515

[56] References Cited

U.S. PATENT DOCUMENTS

| | | | |
|---|---|---|---|
| 3,955,189 | 5/1976 | Thomson | 345/193 |
| 4,131,883 | 12/1978 | Lundstrom | 345/194 |
| 4,231,021 | 10/1980 | Clark et al. | 395/166 |
| 4,613,852 | 9/1986 | Maruko | 345/188 |
| 4,704,697 | 11/1987 | Kiremidjian et al. | 395/153 |
| 4,712,099 | 12/1987 | Maeda | 345/199 |
| 4,727,362 | 2/1988 | Rackley et al. | 345/22 |
| 4,773,026 | 9/1988 | Takahara et al. | 345/186 |
| 4,796,203 | 1/1989 | Roberts | 345/200 |
| 4,862,150 | 8/1989 | Katsura et al. | 345/153 |
| 4,945,499 | 7/1990 | Asari et al. | 395/160 |
| 4,979,738 | 12/1990 | Frederiksen | 273/436 |
| 5,043,714 | 8/1991 | Perlman | 345/196 |
| 5,131,080 | 7/1992 | Fredrickson et al. | 345/190 |
| 5,161,221 | 11/1992 | Van Nostrand | 345/203 |
| 5,231,383 | 7/1993 | Diepstraten et al. | 345/200 |

*Primary Examiner*—Steven J. Saras

*Attorney, Agent, or Firm*—Townsend and Townsend and Crew LLP

[57] ABSTRACT

The invention concerns loading data into VIDEO RAM in a computer. A processor delivers data to VIDEO RAM by using "STRING OPs," which are data-copying operations wherein a field of consecutive data words is copied from one location (such as character memory) to a range of consecutive addresses at another location (such as VIDEO RAM). The invention intercepts the words intended for the consecutive addresses, and distributes them into VIDEO RAM at evenly spaced, non-consecutive addresses. When a graphics controller generates pixels on a display, based on these evenly-spaced addresses, the pixels will automatically occupy a vertical column on the display.

7 Claims, 13 Drawing Sheets

STEP ADDRESSING IN VIDEO RAM

The invention concerns procedures and apparatus for expedited loading of data into video RAM in a computer.

BACKGROUND OF THE INVENTION

FIG. 1 illustrates a video display containing 40 rows of 48 pixels each. (Actual displays used in computers are much larger. In 1993, 480 rows×640 columns is a common size.) Every pixel is associated with a memory location, or cell, in VIDEO RAM. (RAM is an acronym for Random Access Memory.)

For simplicity, it is assumed that each VIDEO RAM cell contains one bit. When the bit is a ONE, the corresponding pixel is dark; when the bit is a ZERO, the corresponding pixel is light. A video controller, known in the art, converts the bits stored in VIDEO RAM into bright and dark pixels.

(In actuality, more than a single bit is stored for each pixel, because the bits must indicate each pixel's color and intensity, not merely whether the pixel is dark or light.)

FIG. 2 illustrates the correspondence between the VIDEO RAM locations and the pixels. The pixels in a given row are grouped into groups of eight bits. Each eight-bit group is stored as a byte of data in VIDEO RAM. Group 1 in row 1 is stored as the byte at VIDEO RAM address 1. Group 2 in row 1 is stored as the byte at VIDEO RAM address 2, and so on.

This leads to a very important point, namely, that the bytes for a given row are located at adjacent addresses in VIDEO RAM. For example, the bytes for ROW 1 are located at addresses 1 through 6; for ROW 2, at addresses 7 through 12, and so on.

Advantage of Adjacency in VIDEO RAM

This adjacency has advantages and disadvantages. An advantage is the ability to obtain access to the VIDEO RAM locations by using "page mode addressing." For example, in ordinary, non-page-mode, addressing, the address for the memory locations is commonly broken into two parts, namely, a row address and a column address. Both the row and the column address are given to the VIDEO RAM, in order to address a given memory location.

However, in page mode addressing, two addressing operations are not required, for certain sequential addresses. Instead, a row address is first given to the VIDEO RAM. The row is a "page." Now, access to all columns within that row (or page) can be obtained by giving a single column address. Addressing the columns within the row is now faster, because only a single piece of data (a column address) is required for each address in the row, rather than the complete row-column pair.

Thus, in FIG. 2, ROW 1 can be treated as one page, and read rapidly. The other ROWs can be treated the same way. The fact that a row of pixels occupies adjacent addresses in VIDEO RAM allows fast reading of the pixels, by using page-mode addressing.

Disadvantage of Adjacency

The adjacency presents a disadvantage for loading data into VIDEO RAM (as opposed to reading the data).

The disadvantage will be explained with reference to FIG. 3. Assume that the letter "d" is to be displayed on the display, at the location shown in that Figure. The "d" occupies a block of pixels which is eight pixels wide, and ten pixels tall.

FIG. 4 illustrates the top ten lines (ie, rows) of the display, together with the corresponding VIDEO RAM addresses. FIG. 5 is substantially the same as FIG. 4, but with the top ten lines separated, and the pixel groups labeled with their corresponding addresses in VIDEO RAM. For example, pixel GROUP 1 corresponds to VIDEO RAM address 1.

In the top ten lines of the display, the letter "d" will occupy the left-most column of groups, namely, the following groups as defined in FIGS. 5 and 6:

| Groups of Bits in FIGS. 5 and 6 Occupied by Letter "d" |
|---|
| 1 |
| 7 |
| 13 |
| 19 |
| 25 |
| 31 |
| 37 |
| 43 |
| 49 and |
| 55. |

In FIG. 6, the pixel image of the "d" is illustrated in the lower left corner. Each pixel group is labeled, both in the pixel image, and in the top ten rows (located above the image). The dashed arrows indicate how pixel groups 1 and 2 (for example) correspond to VIDEO RAM addresses 1 and 2.

To display the letter "d," the following data must be loaded and stored into the following addresses, located in the left column of GROUPS, as FIG. 6 indicates:

| VIDEO RAM ADDRESS (Decimal) | DATA STORED |
|---|---|
| 1 | 0000 0000 |
| 7 | 0000 0100 |
| 13 | 0000 0100 |
| 19 | 0000 0100 |
| 25 | 0001 1100 |
| 31 | 0010 0100 |
| 37 | 0010 0100 |
| 43 | 0001 1100 |
| 49 | 0000 0010 |
| 55 | 0000 0000 |

This data must be loaded by a microprocessor, which, in small computers, is commonly the main processor of the entire system. The data must be copied from another location. FIG. 7 illustrates an example. The data for defining the letter "d" is stored in SYSTEM MEMORY, beginning at address 1000 (decimal). (The defining data for "d" can, of course, be stored at other locations, and in other types of memory, such as on a disc drive.)

The microprocessor must load the byte located at each location in SYSTEM MEMORY into a corresponding location in VIDEO RAM. That is, the following TABLE illustrates how the bytes are copied:

TABLE 1

| BYTE ORIGIN (SYSTEM MEMORY ADDRESS) | BYTE DESTINATION (VIDEO RAM ADDRESS) |
|---|---|
| 1000 | 1 |
| 1001 | 7 |
| 1002 | 13 |
| 1003 | 19 |
| 1004 | 25 |
| 1005 | 31 |
| 1006 | 37 |
| 1007 | 43 |
| 1008 | 49 |
| 1009 | 55 |

A '486 processor, manufactured by Intel Corporation, located in Santa Clara, Calif., performing this loading operation will probably use a routine resembling the following:

Prior-Art Addressing Example (Non-Stepping)

| | | |
|---|---|---|
| MOV CX, COUNT | Load number of lines in character | (1) |
| MOV DI, DISP_ADDRESS | Starting address for character in VIDEO RAM | (2) |
| MOV SI, FONT_START | Starting address of character definition in system memory | (3) |
| DRAW: | | |
| MOVSB | Write out a byte, increment SI and DI | (4) |
| ADD DI, OFFSET | Increment VIDEO RAM address to next line. | (5) |
| LOOP DRAW | Do DRAW routine until CX = 0 | (6) |

In this example, line 1 specifies the number of rows of pixels which a character occupies. In the "d" example above, the number of lines is ten, which corresponds to "CX."

Line 2 specifies the starting address in VIDEO RAM where the character is to be loaded. In the "d" example, the starting address is 1. (See FIG. 6.) "DI" in line 2 is an acronym for "Destination Index."

Line 3 specifies the starting address in SYSTEM MEMORY where the data defining the image of the character is stored. In the "d" example, this address is 1000. (See FIG. 8.) "SI" in line 3 is an acronym for "Source Index."

Lines 4–6 copy the data defining the image of the character from SYSTEM MEMORY into VIDEO RAM. (Line 5 refers to an OFFSET. In the "d" example, the OFFSET is 6. It is the difference between the addresses (eg, 1 and 7) defining the rows of the "d" in the lower left corner of FIG. 6.)

The Problem

In the Intel '486 processors, the instructions executed in the Addressing Example given above require the following clock cycles:

| Instruction | Clocks | |
|---|---|---|
| MOVS | 7 | |
| REP MOVS | 12 + 3C | (12 for setup, then 3 per cycle) |
| LOOP | 7 or 6 | (6 clocks on last cycle) |

-continued

| Instruction | Clocks | |
|---|---|---|
| MOV | 3 | (9 if virtual address) |
| ADD | 2 | |

Total Clock Cycles Required for Addressing Example

Loading a character into VIDEO RAM requires a total of 264 clock cycles, computed as follows:

| | | |
|---|---|---|
| Load CX Register | 3 | |
| Load Destination Address | 3 | |
| Load Source Address | 3 | 9 |
| 15 Repetitions of | | |
| Writing a Byte (MOVSB) | 7 | |
| ADD Offset to Next Line | 2 | |
| LOOP back to label | 7 | 240 |
| Write a Byte (MOVSB) | 7 | |
| ADD Offset to Next Line | 2 | |
| LOOP back to Label | 6 | 15 |
| | | 264 |

OBJECTS OF THE INVENTION

It is an object of the invention to provide an improved system for writing data to VIDEO RAM in computers.

It is a further object of the invention to provide a system for loading VIDEO RAM in which the incrementation of VIDEO RAM addresses is not required of the computer's processor.

It is an object of the invention to provide a system which reduces the number of clock cycles required to load a character into VIDEO RAM.

SUMMARY OF THE INVENTION

In one form of the invention, a processor delivers data to VIDEO RAM by using "STRING OPs," which are data-copying operations wherein a field of consecutive data words is copied from one location to a range of consecutive addresses at another location. The invention intercepts the words intended for the consecutive addresses, and distributes them into VIDEO RAM at evenly spaced, non-consecutive addresses. When a graphics controller generates pixels on a display, based on these evenly-spaced addresses, the pixels will automatically occupy a vertical column on the display.

DETAILED DESCRIPTION OF THE INVENTION

Simplified View

Figure 8:
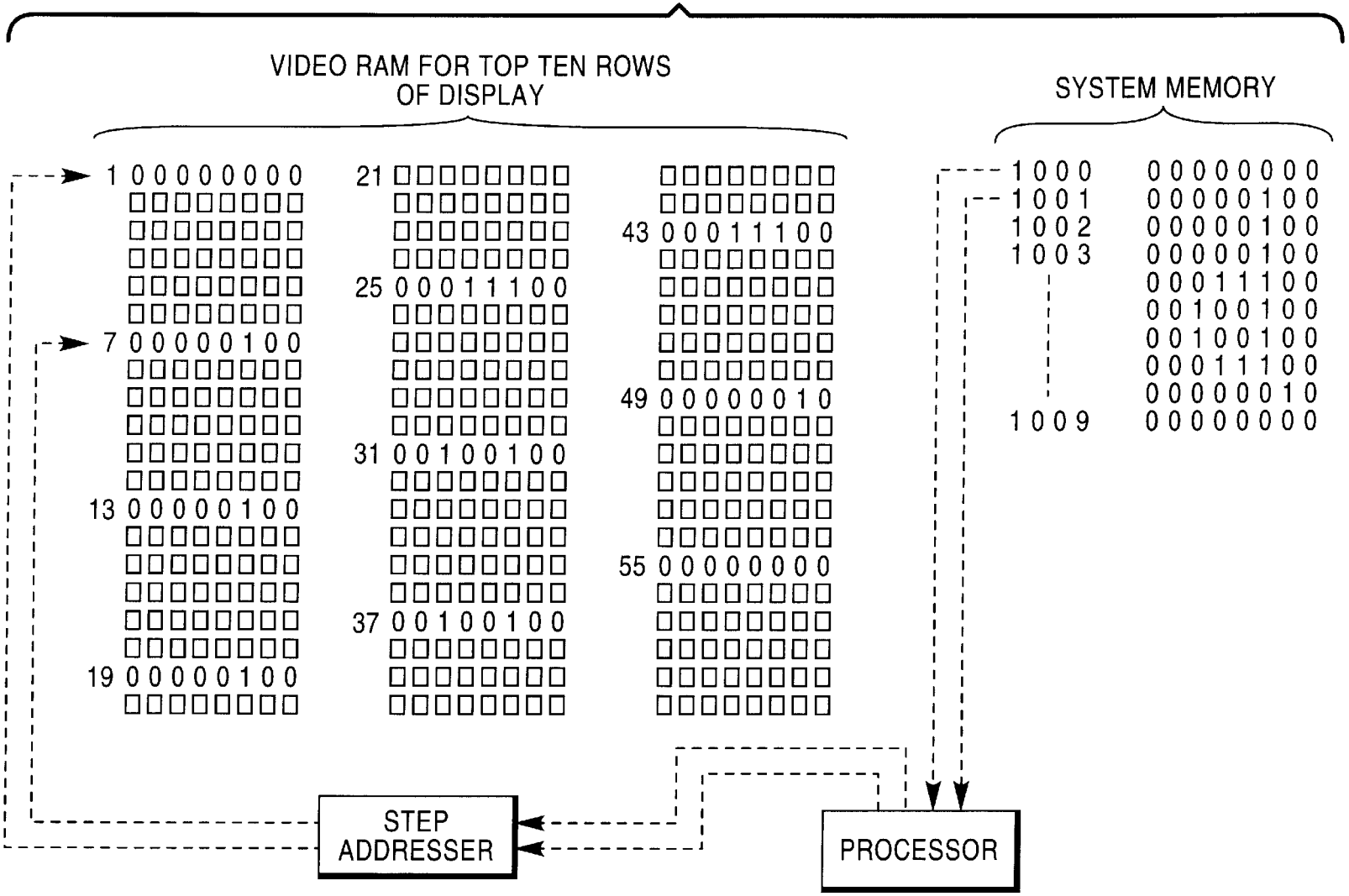
FIG. 8 is a simplified view of one form of the invention.

FIG. 8 illustrates a simplified view of the invention. The processor copies the bytes for the character "d" from SYSTEM MEMORY, as indicated by the arrows flanking the encircled "1". The processor delivers each copied byte to a STEP ADDRESSER, as indicated by the arrows flanking the encircled "2." The STEP ADDRESSER places the bytes at the correct addresses in VIDEO RAM, as indicated, namely at addresses 1, 7, 13, 19, 25, 31, 37, 43, 49, and 55.

Under this arrangement, the processor is not required to specify every destination address in VIDEO RAM. The processor need only specify the first address. The STEP ADDRESSER generates the rest of the addresses which, in this example, are non-consecutive, and evenly spaced (the spacing is six).

Thus, two agents, rather than one, become involved in generating the destination addresses in VIDEO RAM. They perform the addressing tasks somewhat in parallel, thus saving time overall.

More Detailed View

Many microprocessors, such as the 486 family available from Intel Corporation, can copy large blocks of data from one contiguous location to another contiguous location, very fast. For example, the 9,000 bytes located between addresses 1000 and 10,000, can be copied to the addresses located between 20,000 and 29,000.

The microprocessor command which implements this feature is commonly called a string operation, or STRING OP. The invention utilizes STRING OPs.

To execute a STRING OP, whereby a TARGET BLOCK of data is copied from one range of addresses to a range located in VIDEO RAM, the processor is given information about the TARGET BLOCK, which includes the following (or the equivalent):

1. Starting address of the TARGET BLOCK;
2. Length of the TARGET BLOCK (or ending address of TARGET BLOCK); and
3. Starting address in VIDEO RAM where TARGET BLOCK is to be copied.

How STRING OP, by Itself, Cannot Generate Character

Ordinarily, the STRING OP will copy the first byte in the TARGET BLOCK to the starting address in VIDEO RAM (specified in item 3, above). Next, the STRING OP will copy the second byte in the TARGET BLOCK to (starting address+1), and so on. If the TARGET BLOCK occupies addresses 1000 through 1009, and if the starting address in VIDEO RAM is 1, then the TARGET BLOCK will be copied to addresses 1 through 9 in VIDEO RAM.

Figure 1:
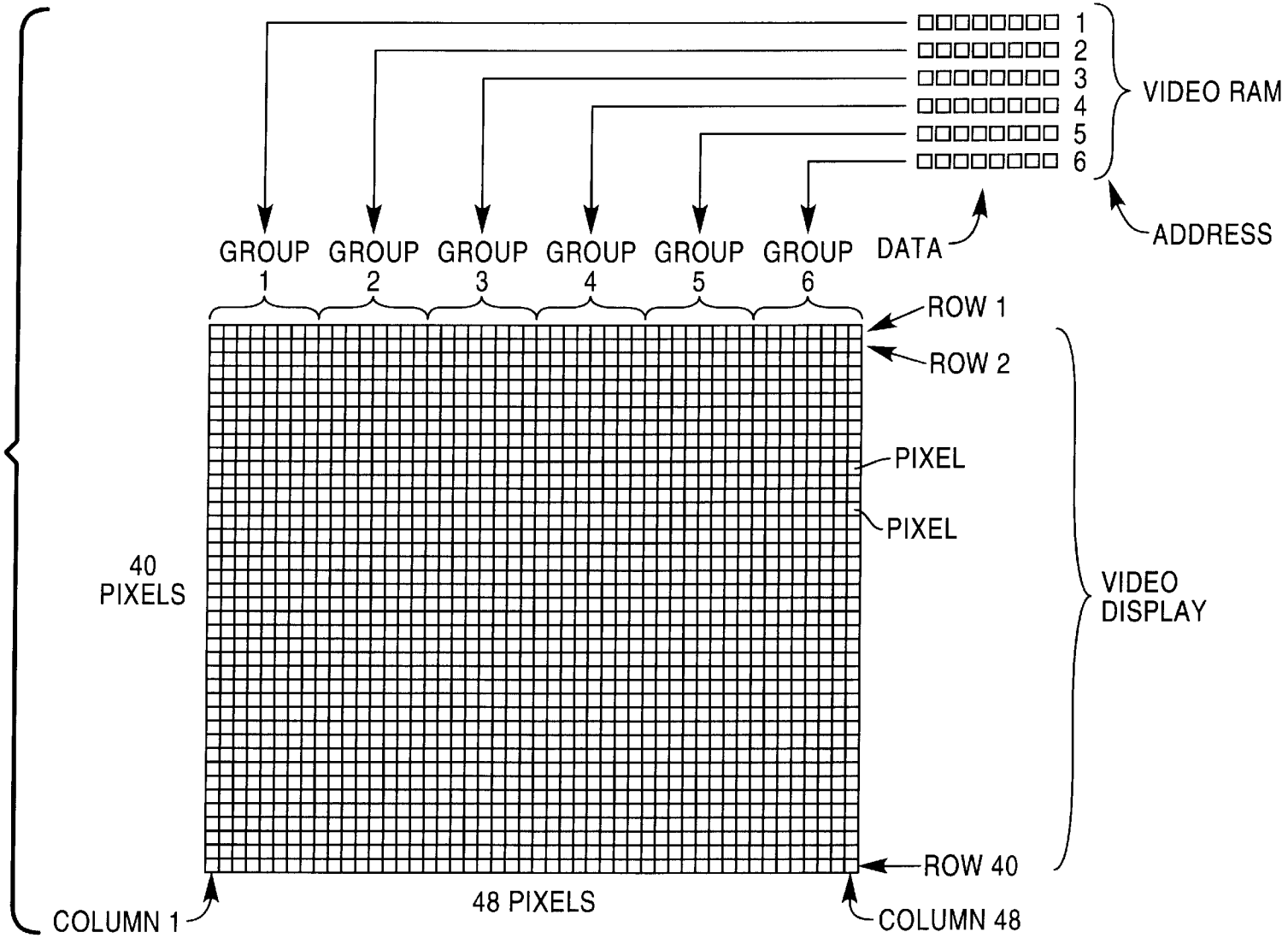
FIG. 1 illustrates a display having 48×40 pixels.
Figure 2:
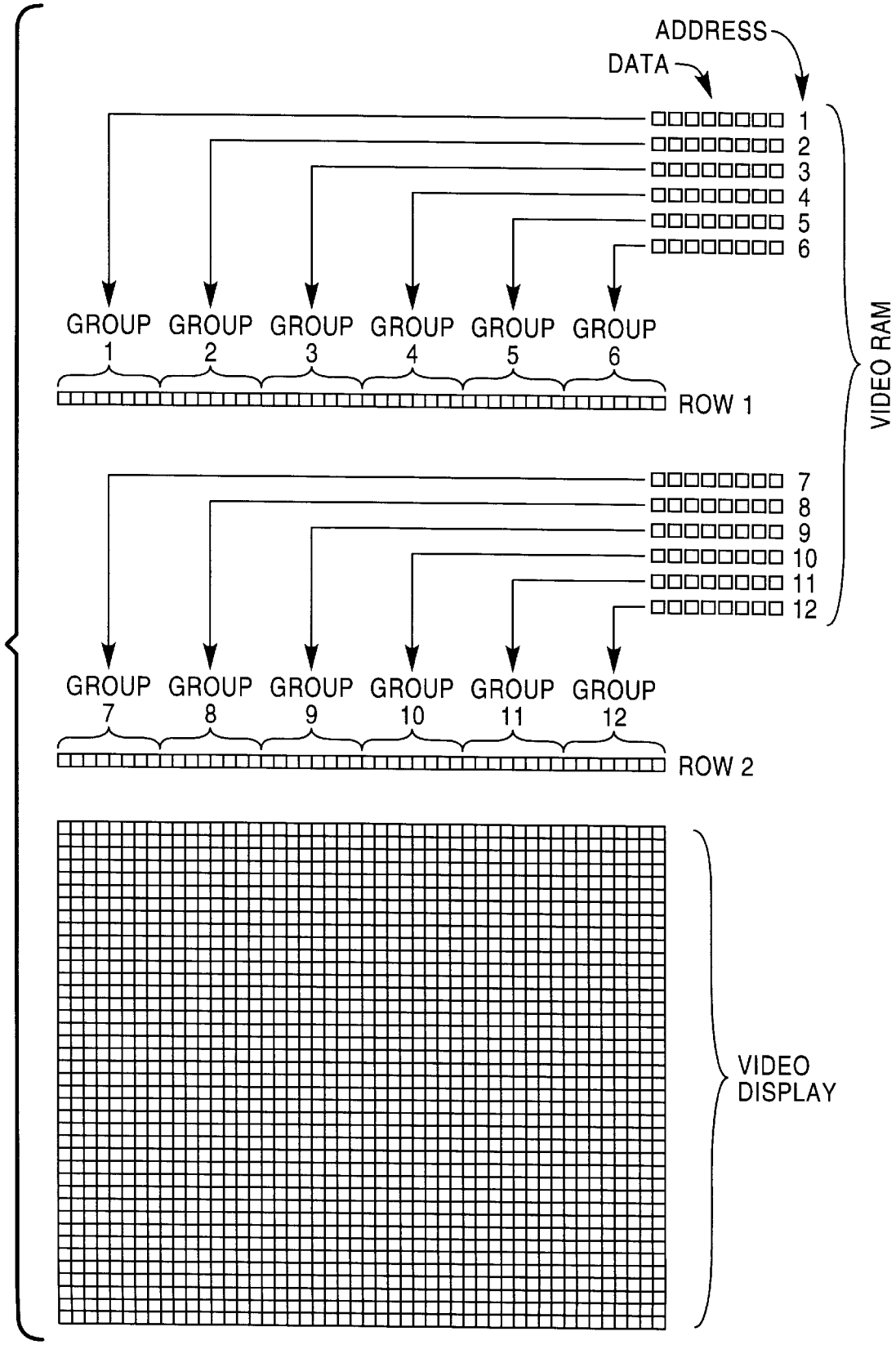
FIG. 2 illustrates the display of FIG. 1, and showing the correspondence between locations in VIDEO RAM and the ROWs of the display.
Figure 3:
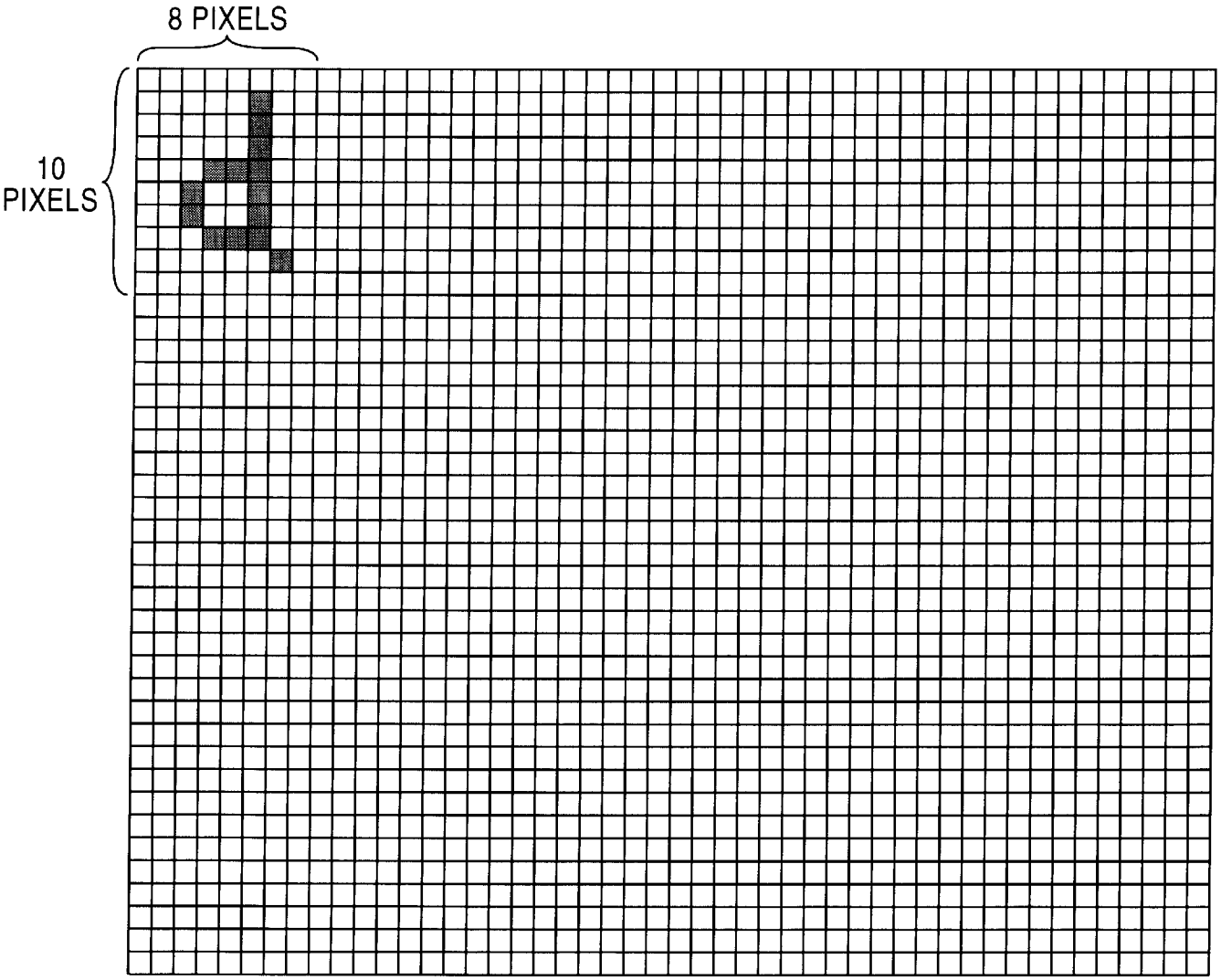
FIG. 3 illustrates how the letter "d" can be written on the display.
Figure 4:
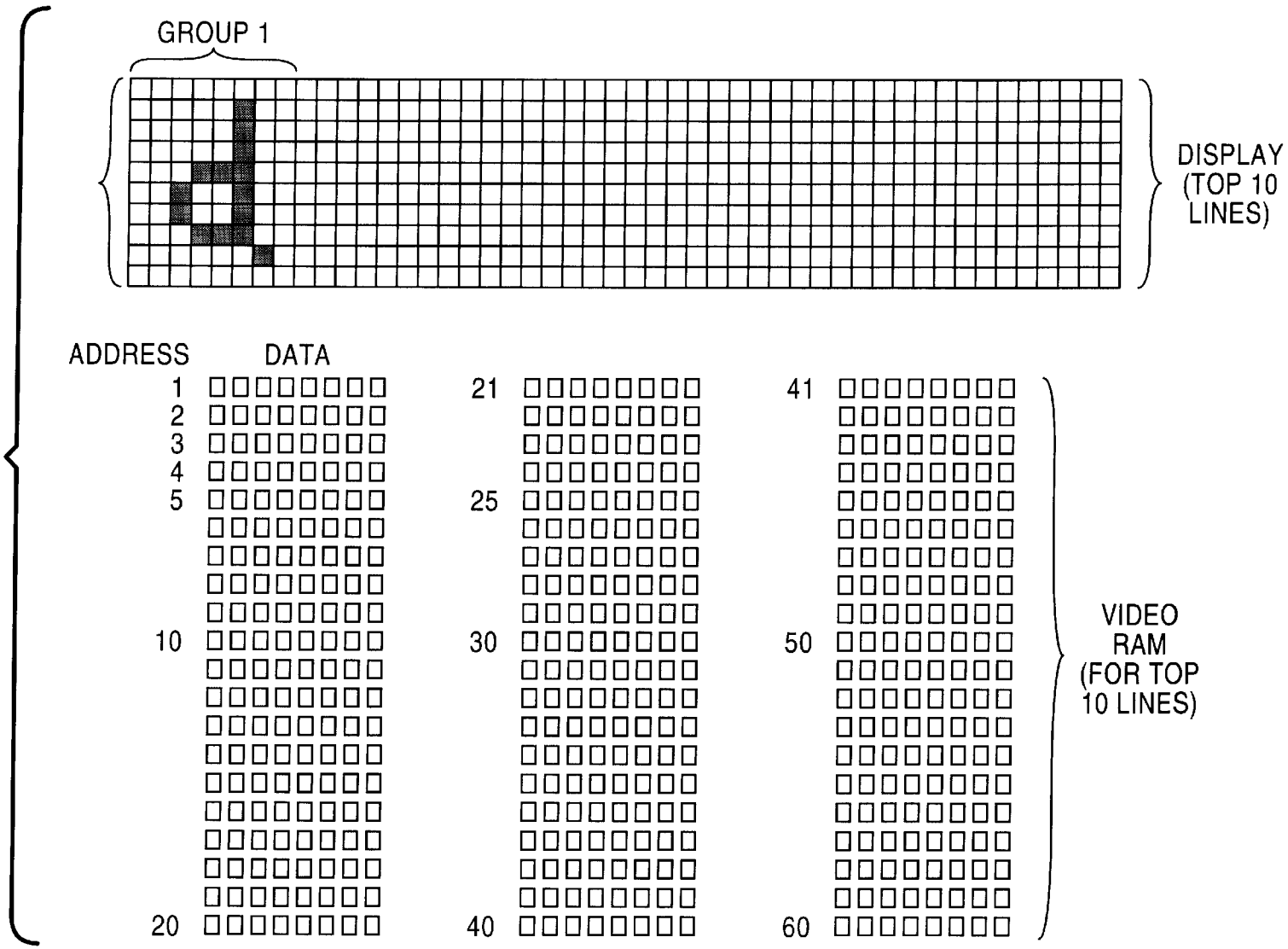
FIG. 4 illustrates the top ten lines of the display, showing the letter "d."
Figure 6:
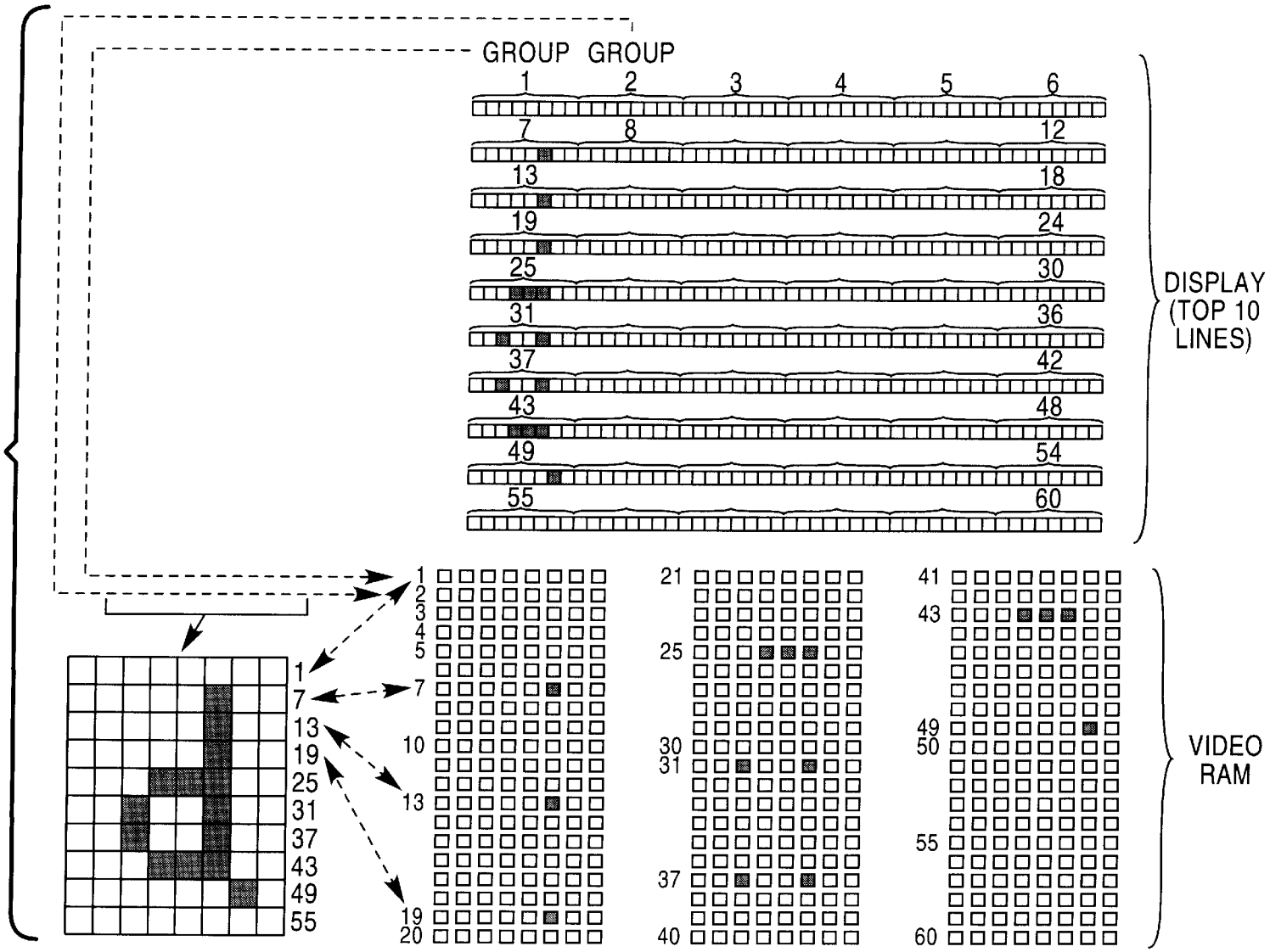
FIG. 6 illustrates how ten specific memory locations in VIDEO RAM are loaded to display the "d."

However, as FIG. 6 indicates, these addresses in VIDEO RAM occupy the top row, together with the left part of the second row. These addresses are incorrect for displaying the character "d" as shown in FIG. 3. These addresses correspond to pixels located in two rows, not to a block of pixels to be occupied by a character.

Invention Uses STRING OP to Generate Character

The invention takes the starting address (specified in item 3, above) as the address in VIDEO RAM for the first byte. The invention ignores the addresses provided by the processor for the rest of the bytes. The invention itself provides the correct addresses for the rest of the bytes. The procedure will be explained in greater detail.

Figure 9:
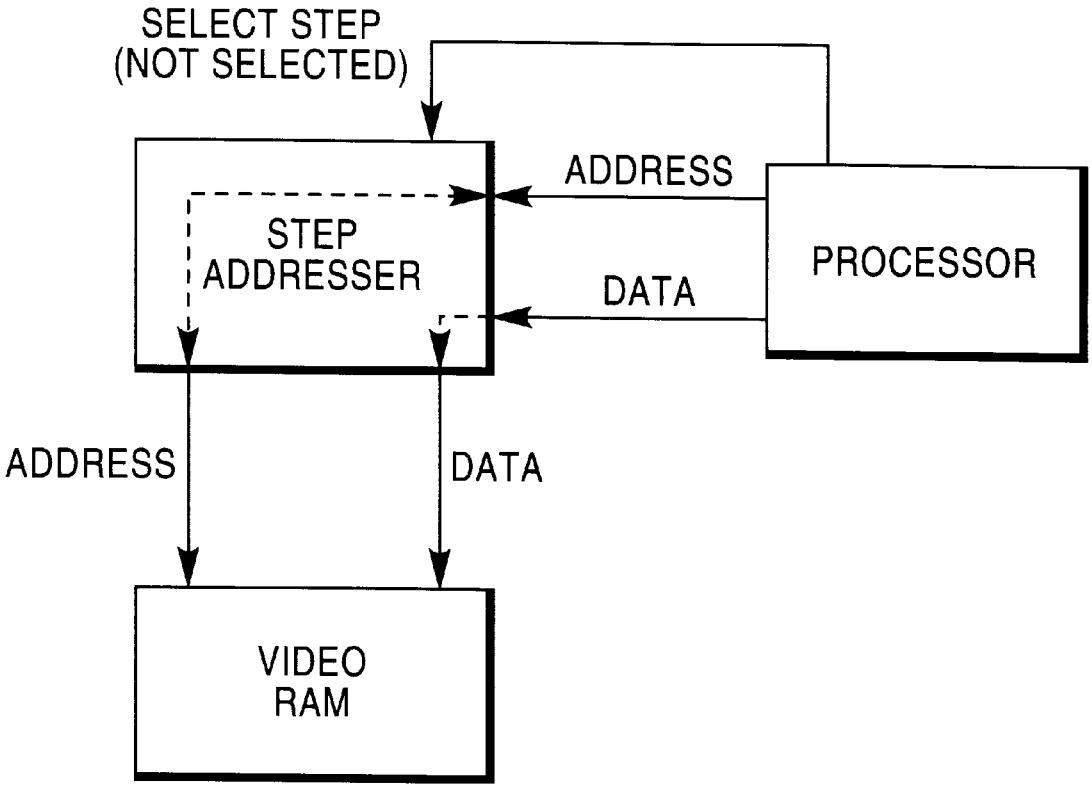
FIG. 9 illustrates how the invention does not inhibit normal VIDEO RAM addressing, when the invention is not invoked.

FIG. 9: Invention Inactive

The processor selects whether to invoke the invention, via the control line SELECT STEP. FIG. 9 illustrates operation when the invention is not invoked. The addresses and data provided by the processor, are both written to VIDEO RAM in the usual manner, as indicated by the dashed arrows. If a STRING OP is being performed, then the processor will write data to consecutive addresses in VIDEO RAM.

(In actuality, the consecutive addresses in VIDEO RAM are not exactly the same as those specified by the processor. In general, a graphics controller (not shown) changes the addresses specified by the processor, in an orderly way, and writes the data to VIDEO RAM at the changed addresses.)

Figure 10:
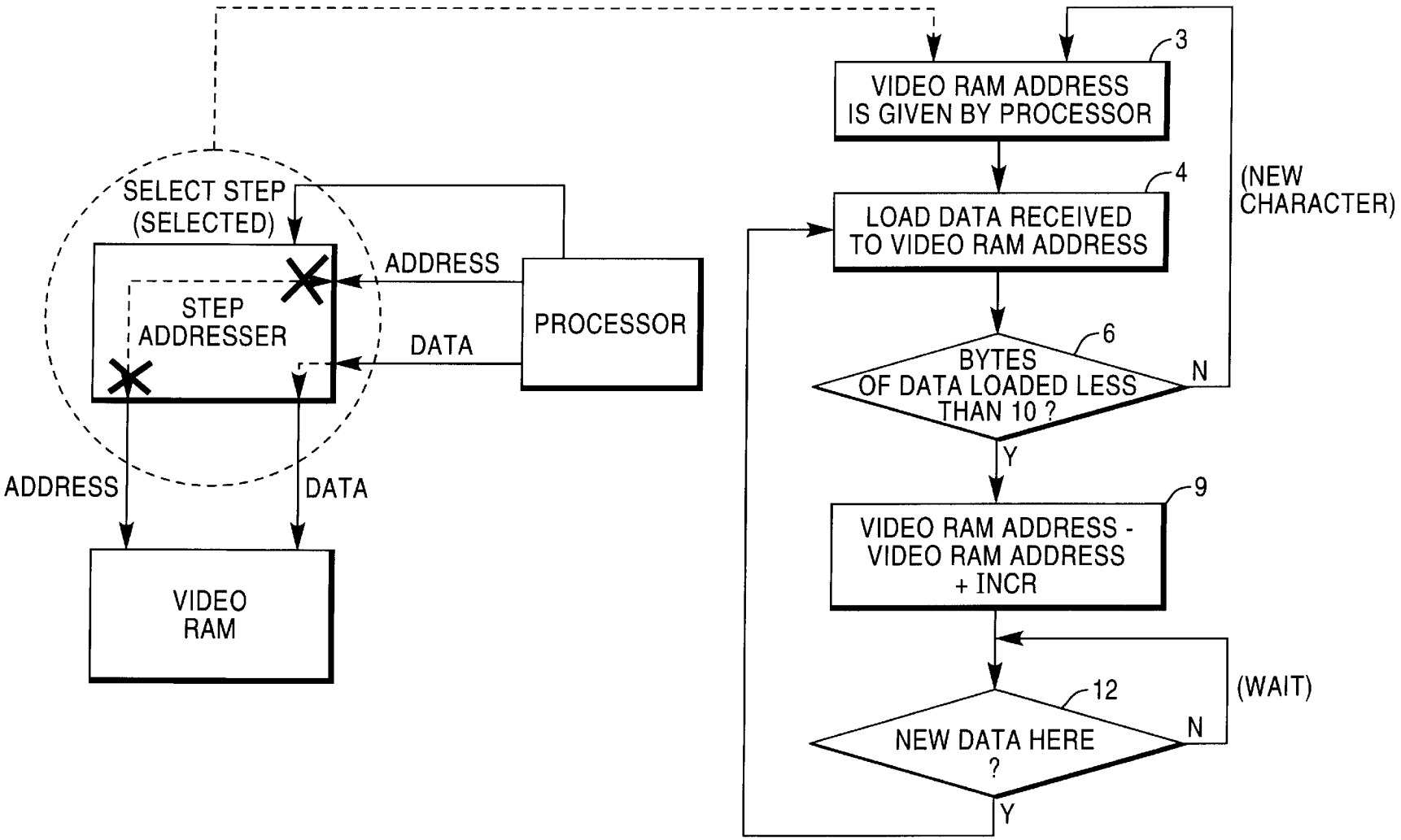
FIG. 10 is a flow chart illustrating one mode of operation of the invention.

FIG. 10: Invention Invoked

If the SELECT STEP line is actuated, then the events of FIG. 10 occur. The address provided by the processor is not sent directly to the VIDEO RAM, as indicated by the X's covering the dashed ADDRESS bus. Instead, the addresses are modified, as the flow chart indicates. (It is assumed that the processor is executing STRING OPs.)

The first byte of data is written into VIDEO RAM at the address specified by the processor, as indicated by blocks 3 and 4. Block 3 sets the variable VIDEO RAM ADDRESS to that provided by the PROCESSOR. If it is assumed that the "d" is to be displayed as in FIGS. 3 and 6, this VIDEO RAM ADDRESS is set to "1."

Block 4 causes the present byte (0000 0000: see FIG. 8) sent by the processor to be loaded into the location in VIDEO RAM specified by VIDEO RAM ADDRESS (ie, "1"). At this point, the operation is the same as usual.

Block 6 counts how many bytes have been loaded. At present, the number loaded is less than ten. Consequently, block 9 is reached, wherein the variable VIDEO RAM ADDRESS is incremented by the number INCR. In this example, INCR equals 6. VIDEO RAM ADDRESS now equals 7.

Block 12 asks whether a new byte has been received from the processor. The handshake lines (not shown) indicate whether a new byte has been received. When a new byte has arrived, block 4 is reached. Now, the second byte (0000 0100: see FIG. 8) is loaded in VIDEO RAM, but six addresses away from the first byte, at address "7" in VIDEO RAM.

The flow chart of FIG. 10 causes the data in SYSTEM MEMORY in FIG. 8 to be loaded at the locations shown in that Figure, and as indicated in Table 1, above.

The invention reduces the number of clock cycles required by the processor to load a character into VIDEO RAM. The processor is now required to execute a program resembling the following.

Addressing Example Using Invention (With Stepping)

MOV CX, COUNT: Load number of lines in character
MOV DI, DISP_ADDRESS: Starting address in VIDEO RAM
MOV SI, FONT_START: Starting address of character definition in system memory
REP MOVSB: Write byte to invention, increment SI and DI until character is written.
The total number of clocks required is

| | | |
|---|---|---|
| Load CX register | 3 | |
| Load destination address | 3 | |
| Load source address | 3_____ | 9 |
| Then 16 MOSB instructions | 12 + 3 * 16 = | 60 |
| | total clocks | 69 |

The total number of clock cycles is less than 80, and is almost 25% of the clock cycles required by the Prior Art Addressing Example given in the Background of the Invention (69 vs 264 cycles).

Implementations

Figure 11:
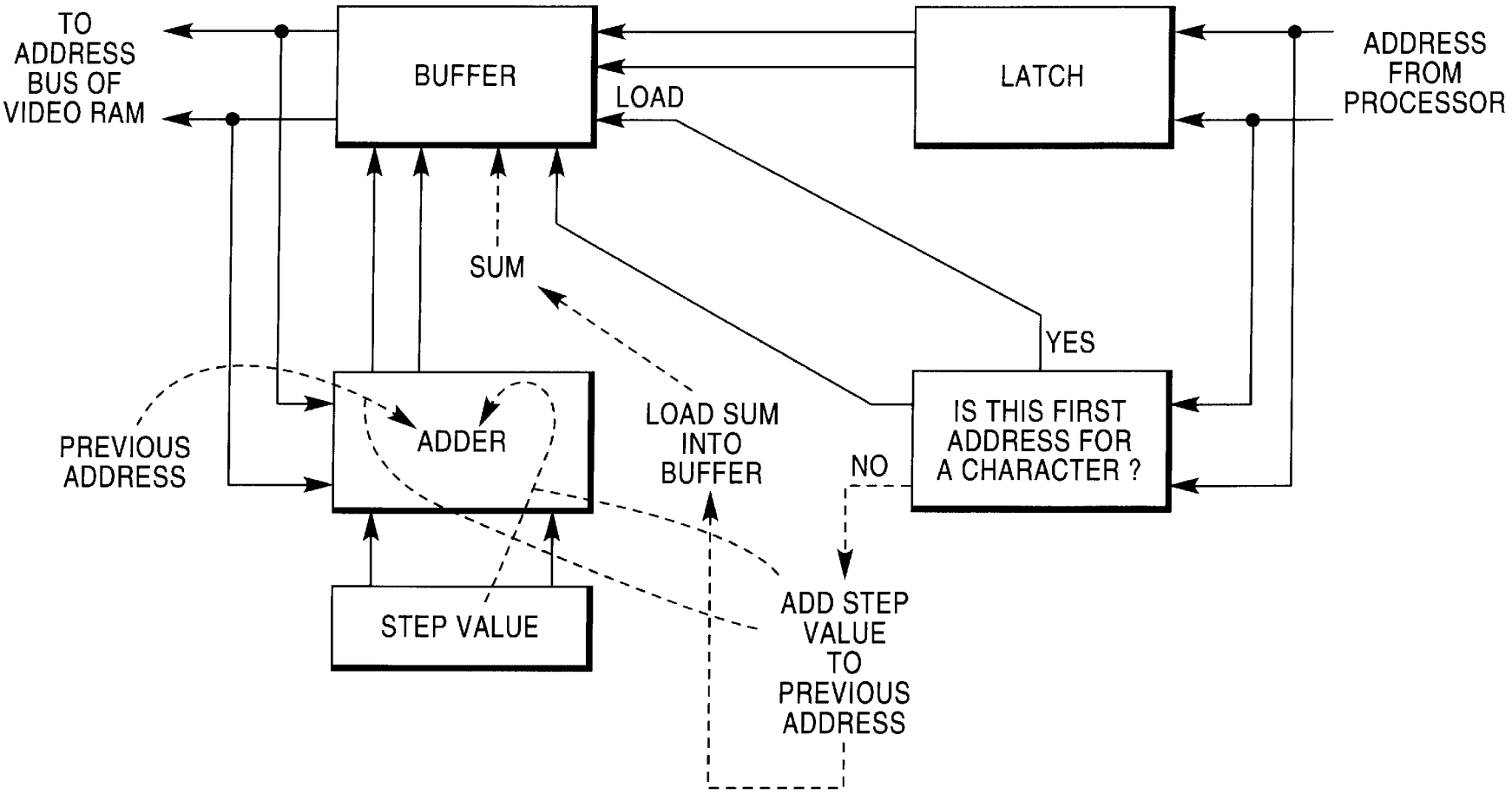
FIGS. 11–13 illustrate architectures which can implement the invention.

FIG. 11 illustrates an architecture which implements the invention. When the processor delivers an address to the LATCH, block 15 inquires whether the address is the first one for a character. If so, the address is loaded into a BUFFER, and is used as the address for the data to be loaded (not shown).

If the address is not the first address for a character, then a STEP VALUE (which is 6 in the example of FIG. 8) is added to the previous address, which is held in the BUFFER, and the SUM is loaded into the BUFFER and used as the address for the next data to be loaded into VIDEO RAM.

The incrementing of the data held by the BUFFER continues until a full character has been loaded into VIDEO RAM. The inquiry of block 15, which, in effect, ascertains when a full character has been loaded, can be done in numerous ways, as will be discussed later.

In general, for the first byte of a character (eg, the byte in SYSTEM MEMORY at 1000 in FIG. 8), block 15 in FIG. 11 will cause the data in the LATCH to be loaded into the BUFFER: the "YES" path is taken. Now, to display the "d" as in FIG. 3, the address "1" (provided by the processor) is sent to the address bus of the VIDEO RAM, The data 0000 0000 (from SYSTEM MEMORY 1000 in FIG. 8) is loaded into this VIDEO RAM address "1."

Next, address "2" is sent by the processor. Block 15 causes the ADDER in FIG. 11 to add the STEP VALUE of 6 to the address presently held by the BUFFER (namely, 1). The result is "7," which is sent to the address bus of the VIDEO RAM. The data 0000 0100 from SYSTEM MEMORY 1001 (FIG. 8) is loaded into VIDEO RAM at address "7," and so on.

To load the last byte for the "d" the processor will send an address of "9" to the LATCH in FIG. 11. The invention, of course, converts this "9" to "55," and loads the data into VIDEO RAM at address 55.

Block 15

Figure 11B:
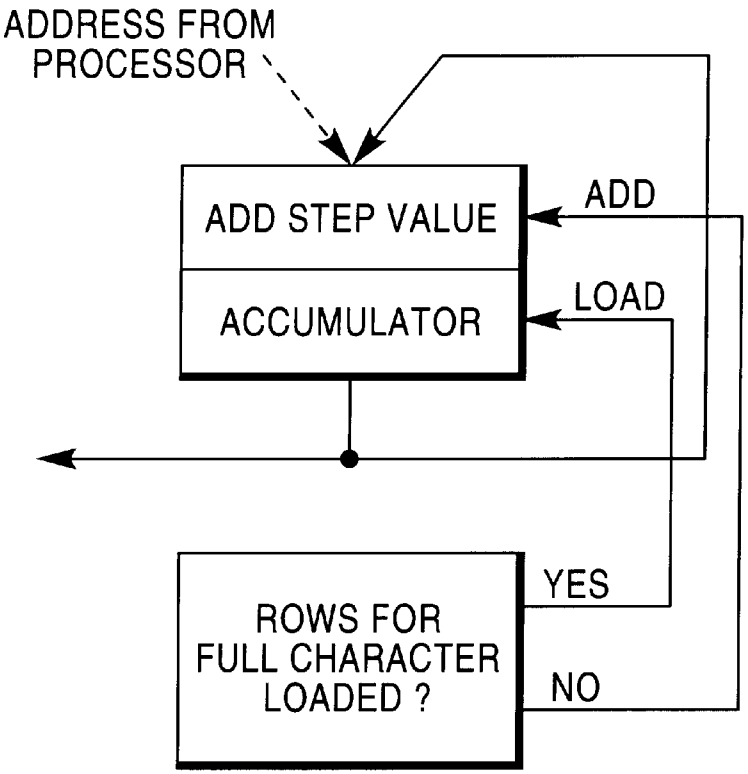
FIGS. 11A and 11B illustrate implementation of block 15 in FIG. 11.
Figure 11A:
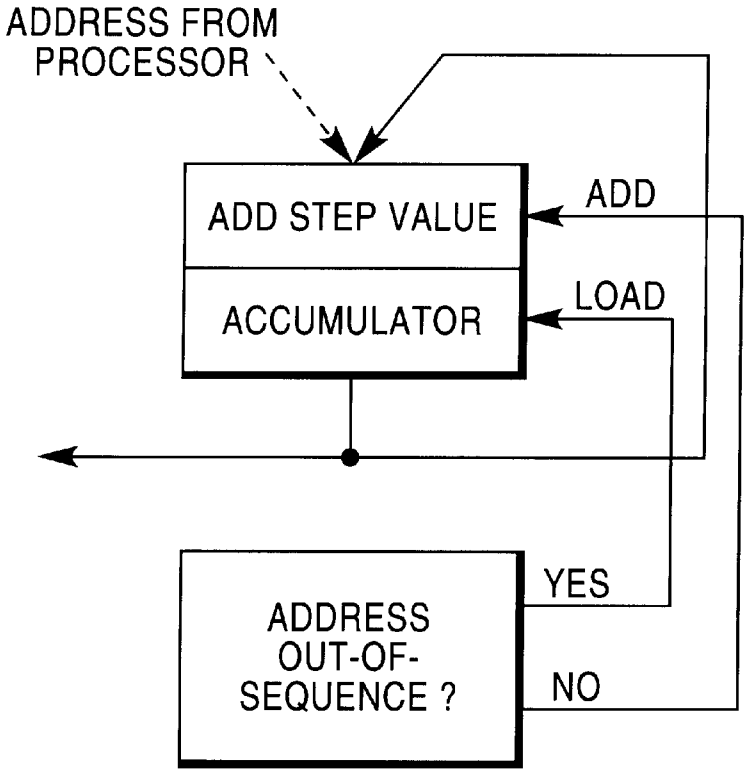

FIGS. 11A and 11B are flow charts illustrating the operation of block 15, and associated blocks, in FIG. 11. In FIG. 11A, the processor has provided a first address, which has been loaded into an ACCUMULATOR. If the next address provided by the processor is consecutive with the address presently stored in the ACCUMULATOR, then block 100 causes a STEP VALUE to be added to the number in the ACCUMULATOR. The resulting SUM is then stored in the ACCUMULATOR, and used as the VIDEO RAM address. This process repeats until a non-consecutive address is received from the processor, at which time the actual address provided by the processor is loaded into the ACCUMULATOR, because a byte for a new character is deemed to have arrived.

Figure 7:
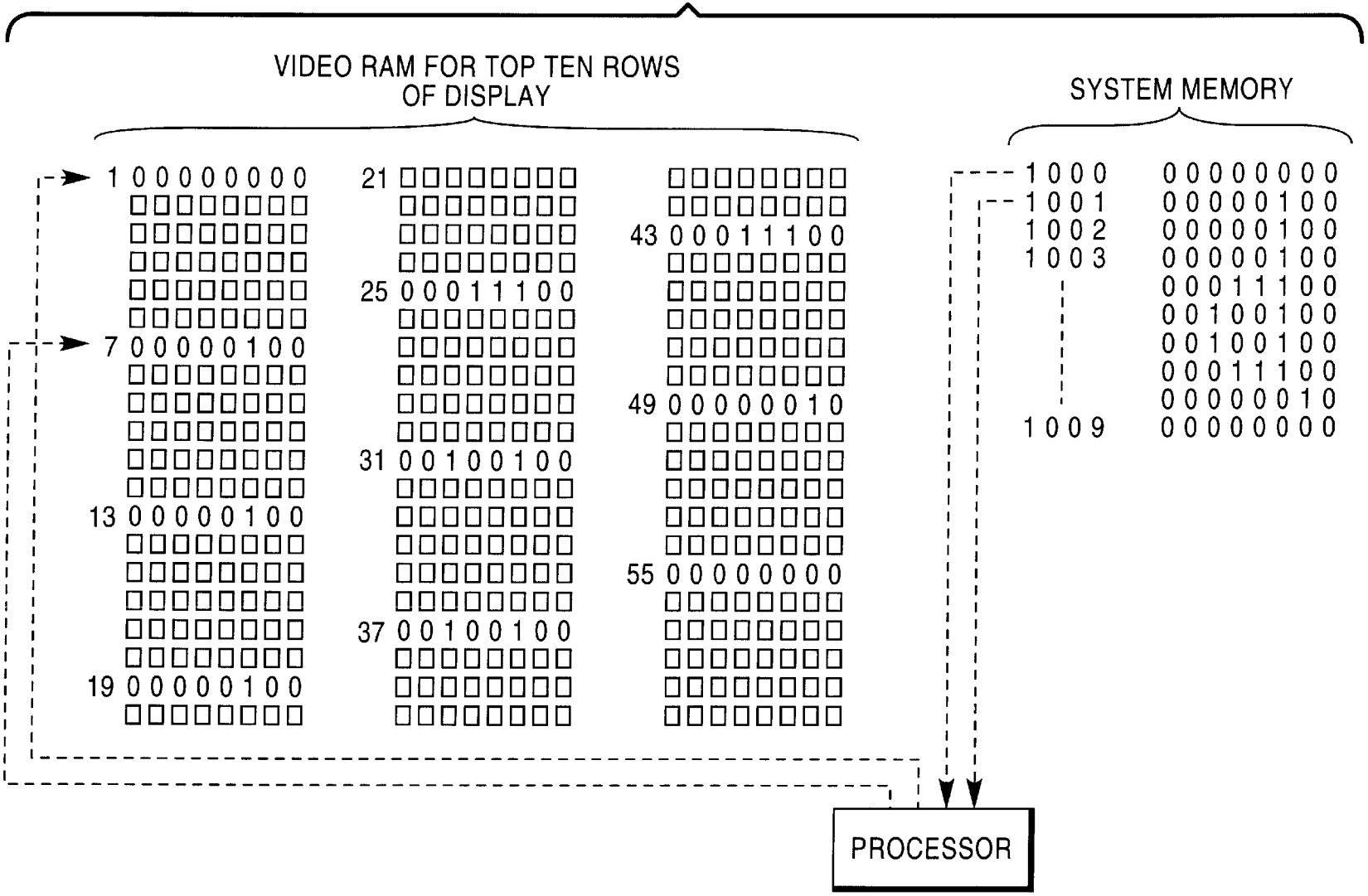
FIG. 7 illustrates how a processor copies data from SYSTEM MEMORY and loads it into VIDEO RAM, to display the "d."

In FIG. 11B, the processor has provided a first address, which has been loaded into an ACCUMULATOR. Block 101 counts an appropriate parameter, which indicates the number of rows of data loaded into VIDEO RAM for the character in question. (FIGS. 6–8 use 10 rows per character.)

For each new address provided by the processor, block 101 causes a STEP VALUE to be added to the number in the ACCUMULATOR. The resulting SUM is then stored in the ACCUMULATOR. However, when block 101 determines that a full character has been loaded into VIDEO RAM, block 101 causes the actual address provided by the processor is loaded into the ACCUMULATOR, because the first byte of a new character is deemed to have appeared.

Second Embodiment

Figure 12:
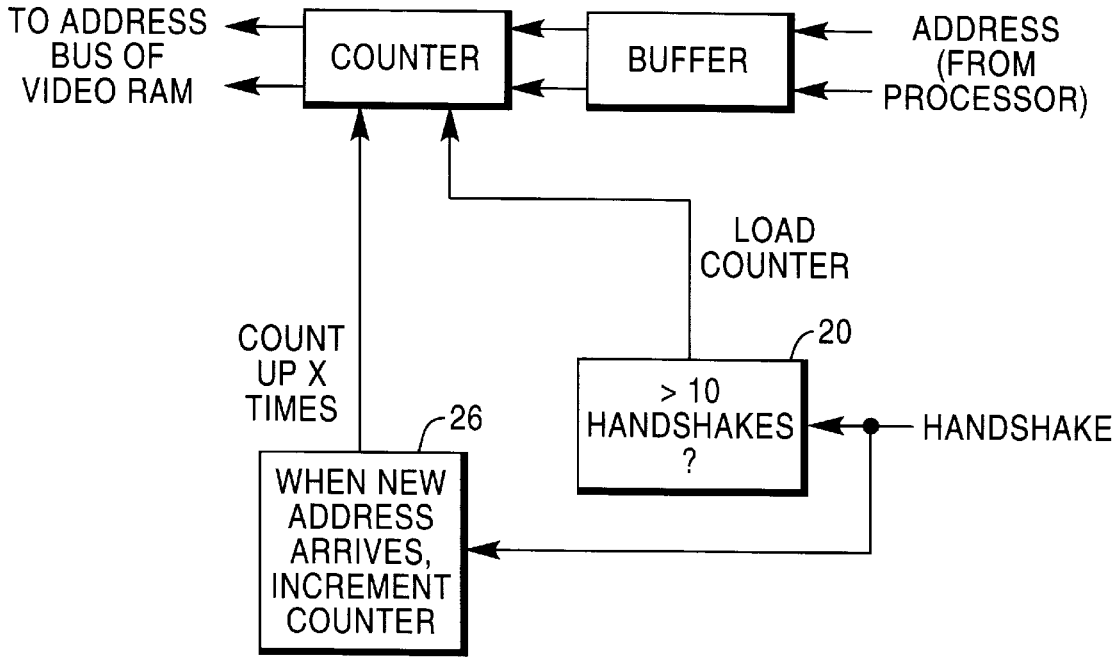

FIG. 12 illustrates another embodiment. The address provided by the processor, where the data is to be written in VIDEO RAM, is captured by a BUFFER. Block 20 loads every eleventh address into a COUNTER. The COUNTER starts counting at this number. In the example under discussion, for the "d," the number loaded will be "1," corresponding to GROUP 1 in FIG. 6.

When the HANDSHAKE lines indicate that a new byte has arrived, block 26 increments the counter X times. X, in this example, is six. Accordingly, the second byte is loaded into VIDEO RAM at address 7, and all of the bytes are loaded according to TABLE 1, above.

Third Embodiment

Figure 13:
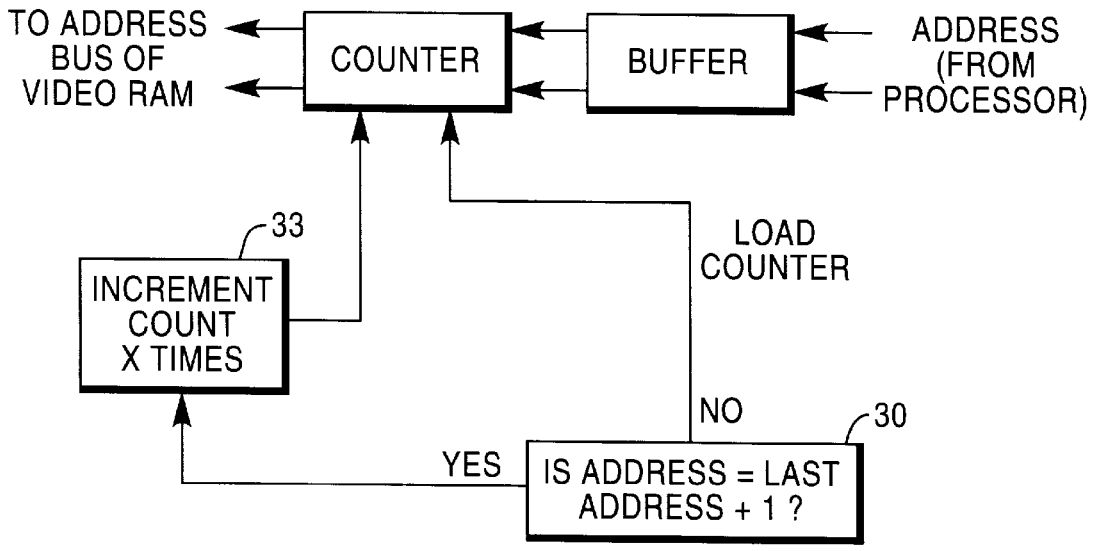

FIG. 13 illustrates a third embodiment. FIG. 13 is similar to FIG. 12, with the exception that, instead of loading every eleventh address, and using it as a starting point for the incrementation provided by block 26 and the COUNTER, block 30 inquires whether the present address is consecutive with the previous address. If so, the COUNTER is incremented. If not, the address is loaded into the COUNTER and used as the starting point.

Fourth Embodiment

FIG. 11 can be arranged so that the ADDER is actuated every time a new address is received by the LATCH, but the BUFFER is loaded by the LATCH at every eleventh byte, as in FIG. 13.

Important Considerations

1. In general, during the writing of a byte to VIDEO RAM by the processor, using STRING OPs, the following events, or equivalent, will occur:

A. The processor will copy a byte from address S in a source, such as system memory;

B. The processor will place this address on a data bus intended for VIDEO RAM;

C. The processor will provide an address D for which the byte is destined;

D. The processor will actuate a handshake line, indicating that data is ready and stable;

E. The VIDEO RAM, or the invention, will take the data, and acknowledge receipt of it, on the handshake lines;

F. The processor will see the acknowledgement, and repeat data transfer, by taking data from S+1 (as in A, above), but attempting to sent it to an address of D+1 (as in C, above).

At some time during these actions, the invention increments the address to which the byte will be sent in VIDEO RAM, as by triggering block 33 in FIG. 13.

That is, the invention generates the recipient address in VIDEO RAM, while the processor is copying and sending data to VIDEO RAM. It is a parallel operation.

Moreover, the processor sends an address with each byte. The invention uses only the address accompanying the first byte, and ignores the rest.

It may be thought that this generation of unused addresses by the processor is a waste of resources. However, this address generation is part of the STRING OP process. The invention utilizes part of this process because the overall process is fast, despite the generation of unwanted addresses.

Figure 5:
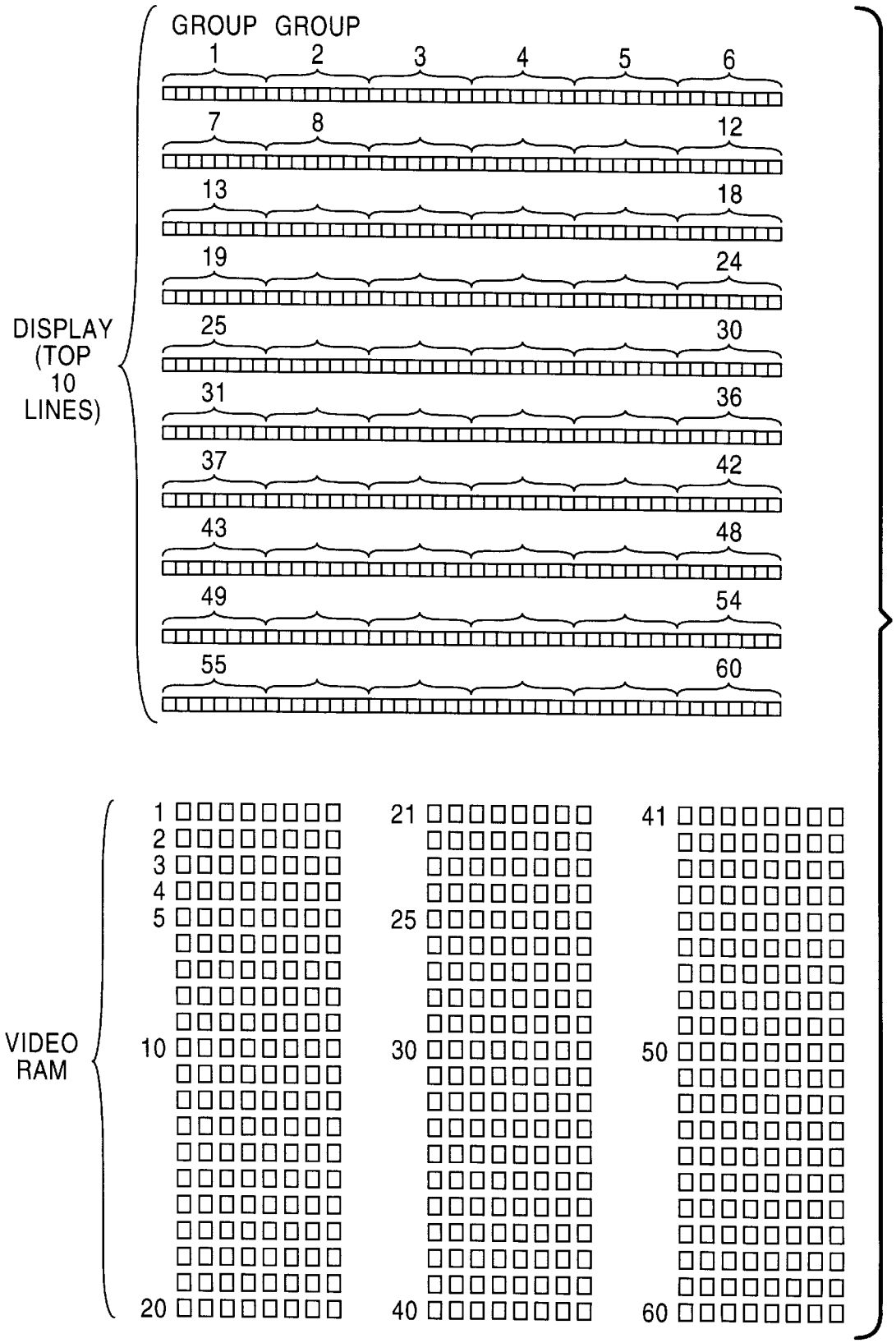
FIG. 5 illustrates the top ten lines of FIG. 4, but in exploded form.

2. The example given above used a 48×40 display. The increment number was "6," because all neighboring GROUPS in FIG. 5, in a single column, are separated by 6 bytes in VIDEO RAM.

However, if each pixel requires a byte of VIDEO RAM, rather than one bit, as assumed above, then the increment number will be "48. " For example, in VIDEO RAM, 48 bytes will separate the left-most pixel in GROUP 1 in FIG. 5 from the left-most pixel in GROUP 7.

If the display is larger, then the INCREMENT number will change correspondingly.

3. The SYSTEM MEMORY range shown in FIG. 7 may be viewed as a consecutive data field. All addresses within the field are consecutive, and part of the definition of the character "d."

4. The processor provides the following string of destination addresses, each of which is associated with one of the bytes copied from SYSTEM MEMORY, as in FIG. 5:

1, 2, 3, 4, 5, 6, 7, 8, 9, and 10.

The invention converts this string to the following string, and associates it with the respective bytes:

1, 7, 13, 19, 25, 31, 37, 43, 49, 55.

This latter string represents evenly-spaced addresses in VIDEO RAM. The address spacing is six.

In general, the destination addresses, provided by the processor, increment according to the formula:

base, base+1, base+2, base+3, etc.

In general, the invention constructs destination addresses according to the formula:

base, base+INCR, base+2×INCR, base+3×INCR, etc.

5. The step value (termed "INCR" in Point 4, above) added to the base need not be constant. That is, a constant value will cause the bytes written to VIDEO RAM to produce pixels in a vertical column. For example, applying FIG. 6 to the invention, a STEP value (or INCR) of 6 causes the "d" to be written in a column. In contrast, a varying STEP value will cause the rows to be displayed along a diagonal.

Further, the STEP value need not increase, but can decrease. Also, the STEP value can be computed according to a function.

6. The STRING OP data would ordinarily be copied into adjacent addresses in VIDEO RAM, such as addresses 1, 2, 3, 4, etc. in FIG. 5. This data in VIDEO RAM will actuate consecutive pixels in a row: first one row will be actuated (by addresses 1 through 6 in FIG. 5), then the next row will be actuated (by addresses 7 through 12), and so on.

The invention distributes the data words (or bytes) into VIDEO RAM, such that consecutive bytes written by the processor actuate pixels in a single column, not adjacent pixels in a row. For the "d" in FIG. 6, the columns of pixels actuated are 1 through 8, in rows 1 through 10.

7. The term VIDEO RAM was used above. Other terms referring to the same equipment are display memory and frame buffer.

8. The memory locations where characters are defined, such as that beginning at addresses 1000 in FIG. 8, are commonly called CHARACTER MEMORY. The data itself is commonly called CHARACTER DATA. The PROCESSOR in FIG. 8 fetches the CHARACTER DATA, and passes it to the invention. The invention, within 80 clock cycles, writes the data to the spaced locations in VIDEO RAM.

A graphics controller (or video controller), known in the art, generates pixels on the display, based on this CHARACTER DATA in VIDEO RAM. The pixels form a character on the display which, in the example of FIGS. 6–8, occupy a matrix of 8×10 pixels. (More generally, the matrix is M×N pixels. Neither M nor N can be smaller than four.)

Numerous substitutions and modifications can be undertaken without departing from the true spirit and scope of the invention. What is desired to be secured by Letters Patent is the Invention as defined in the following claims.

I claim:

1. A method of copying data to video RAM in a computer, comprising the following steps:

a) ordering a processor to copy a consecutive data field to consecutive addresses in video RAM; and b) receiving the consecutive data field from the processor, and distributing it to non-consecutive addresses in video RAM.

2. A method of copying data to video RAM in a computer, comprising the following steps:

a) ordering a processor to copy a consecutive data field to consecutive addresses in video RAM;

b) receiving the data field from the processor, and distributing it to non-consecutive, evenly spaced addresses, in video RAM.

3. A system for transferring character data from character memory into video RAM in a computer, comprising:

a) a processor for fetching the data;

b) means for:

i) receiving the character data from the processor, and ii) writing the character data for a full character into video RAM, within 80 clock cycles, at evenly spaced addresses.

4. Apparatus according to claim 3 in which the character data occupies 8×10 pixels.

5. A system for transferring character data for a full character from character memory into video RAM in a computer, comprising:

a) a processor for fetching the data;

b) means for i) receiving the character data from the processor, and ii) writing the character data to video RAM, within 80 clock cycles, at locations where a graphics controller generates an M×N character, based on the character data.

6. Apparatus according to claim 5 in which M equals 8 and N equals 10.

7. In a computer, the improvement comprising:

a) a processor capable of copying a field of consecutive data words to a range of consecutive addresses; and b) means for receiving data words intended for said range, and distributing the data words into VIDEO RAM, such that consecutive bytes written by the processor actuate pixels in a single column.

* * * * *